US007200876B2

(12) United States Patent
Chiang

(10) Patent No.: US 7,200,876 B2
(45) **Date of Patent: *Apr. 10, 2007**

(54) SWIMMING GOGGLES FOR SWIMMING POOL PURPOSES

(76) Inventor: Herman Chiang, 11F-2 No. 634-9 Ching-Ping RD., Chung-Ho City, Taipei Hsien (TW)

( * ) Notice: Subject to any disclaimer, the term of this patent is extended or adjusted under 35 U.S.C. 154(b) by 0 days.

This patent is subject to a terminal disclaimer.

(21) Appl. No.: 10/396,779

(22) Filed: Mar. 26, 2003

(65) Prior Publication Data

US 2004/0187197 A1 Sep. 30, 2004

(51) Int. Cl.
*A61F 9/02* (2006.01)

(52) U.S. Cl. ..... 2/445

(58) Field of Classification Search ..... 2/445, 2/446, 452; 351/43

See application file for complete search history.

(56) References Cited

U.S. PATENT DOCUMENTS 6,119,277 A * 9/2000 Chiang ..... 2/428
6,247,187 B1 * 6/2001 Chiang ..... 2/428
6,349,417 B1 * 2/2002 Chiang ..... 2/428
6,530,093 B1 * 3/2003 Chiang ..... 2/428
6,546,565 B2 * 4/2003 Chiang ..... 2/428
6,581,213 B2 * 6/2003 Chiang ..... 2/428

* cited by examiner

*Primary Examiner*—Katherine M Moran
(74) *Attorney, Agent, or Firm*—Troxell Law Office, PLLC

(57) ABSTRACT

A pair of swimming goggles for swimming pool purposes of the present invention comprises left and right lens frames each having an inner surface and an outer surface, a bridge member integrally formed between the inner sides of the left and right lens frames, and a gasket integrally on the inner surface of the left and right lens frames. The feature of the present invention is that the bridge member includes a connection section and an adjustment section, wherein both ends of the connection section is integrally disposed on the upper edge of the inner sides of the left and right lens frames. The adjustment section at least includes a flexible thread arranged below the connection section, and a joint member formed on the left or right lens frames for being inserted through by the flexible thread and a coupling passage defined on the left or right lens frames for securing the flexible thread. Due to such a feature, the bridge member can be adjusted according to the height and the width of a nose bridge of a wearer for properly matching the height and width of the nose bridge of the wearer and providing a comfort wearing and effective water-tightness. Additionally, such a structure is cost efficient.

11 Claims, 5 Drawing Sheets

SWIMMING GOGGLES FOR SWIMMING POOL PURPOSES

FIELD OF THE INVENTION

The present invention relates to a swimming goggle, more particularly, a swimming goggle for swimming pool purposes integrally comprising a pair of tens frames, a bridge member and a gasket, wherein the height and the width of the bridge member of the swimming goggles can be adjusted according to the nose bridge of a wearer thereby providing a reliable and comfort contact and assuring water-tightness.

DESCRIPTION OF THE RELATED ART

Generally, two types of swimming goggles are currently used. One type includes separately made dual single-lens frames and a bridge member. The other type in which the present invention involves includes integrally made lens frames and a bridge member. However, the bridge member thereof can not be adjusted according to the nose bridge of a wearer. Moreover, the bridge member thereof is disposed adjacent to a central position between a pair of lens frames which corresponds to the nose bridge of the wearer. Nevertheless, the height of the nose bridge is different from person to person. For a wear who has a relatively high nose bridge, the bridge member of a prior art might overly press his nose bridge resulting in discomfort of the nose bridge.

Moreover, when the conventional swimming goggles are used, the lens frames thereof are pulled by the head strap located at the lateral sides of the lens frames such that the lateral sides of the bottom edges of the lens frames are rearwardly and upwardly deformed. The aforementioned integrally made type swimming goggles also have the same problem. The integrally made swimming goggles have an integrally made bridge member which is disposed adjacent to a central position between a pair of lens frames. Thus, when by pulling the head strap the swimming goggles are sleeved on the head and fixed, the aforementioned pair of lens frames is pulled rearwardly and upwardly. However, the lens frames can not be properly deformed due to the resistant pullback of the bridge member thereby resulting in partial deformation of the bridge member or the bottom edge of the lens frames. If the nose bridge of a wearer is relatively high, the nose bridge would be overly pressed in the case described above resulting in discomfort of the nose bridge. Furthermore, the pair of lens frames is improperly forced outwardly to contact the eye holes resulting in unreliable contact with the eye holes and consequently the seepage of water.

Besides, to prevent the seepage of water due to the overly pull of the lens frames and the bridge member of the conventional integrally made swimming goggles including lens frames, the bridge member, and the gasket, the arrangement of the head strap must be specially designed and assembled resulting in increased manufacture cost and material management.

SUMMARY OF THE INVENTION

Accordingly, the primary object of the present invention is to provide an integrally made swimming goggles including a pair of lens frames and a bridge member, the integrally made swimming goggles capable of conveniently adjusting the, bridge member according to the height and the width of the nose bridge of a wearer thereby providing the comfort of wearing and desired water-tightness. Moreover, the head strap thereof includes a special and convenient assembly arrangement resulting in decreasing manufacture cost.

The main feature of the swimming goggles for swimming pool purposes is that the bridge member of the swimming goggles of the present invention includes a connection section and an adjustment section, wherein both ends of the connection section are integrally disposed on the upper edge of the inner sides of the left and right lens frames. The adjustment section at least includes a flexible thread arranged below the connection section, and a joint member formed on the left or right lens frames for being inserted through by the flexible thread and a coupling passage defined on the left or right lens frames for securing the flexible thread.

According to the aforementioned feature, the coupling passages are disposed within a leading grooves defined in the lower edges of the left and right lens frames, respectively. The dimension of the leading grooves is slightly smaller than the dimension of the flexible thread thereby securing the flexible thread therewithin.

Another feature of the swimming goggles for swimming pool purposes is that a head strap joint section is kept a certain space from the coupling passage and extends from outer sides of the left and right lens frames. A head strap which is the extension of the flexible thread extends through the joint member and the coupling passage, and is secured at the certain space between the coupling passage and the head strap joint section, then extends through the head strap joint section. Since a part of the flexible thread disposed between the pair of the head strap joint sections is secured by the certain space between the coupling passage and the head strap joint section, when the swimming goggles are used, the head strap joint sections bear the pulling force such that deformation of the lens frames resulting from the pulling is prevented.

The third feature of the swimming goggles for swimming pool purposes is that at least a apertures is respectively defined in the joint member and the head strap joint section. An area between a pair of tangents of the cross section of the aperture of the joint members is completely or partially overlapped with an area between a pair of tangents of the aperture of the head strap joint sections.

The fourth feature of the swimming goggles for swimming pool purposes is that a sleeve section in which a space that is communicated with environment at both ends thereof is mounted within the aperture of the joint section, thereby strengthening the structure of aperture for facilitating the pass of the flexible thread therethrough.

DETAILED DESCRIPTION OF THE PREFERRED EMBODIMENTS

Figure 1:
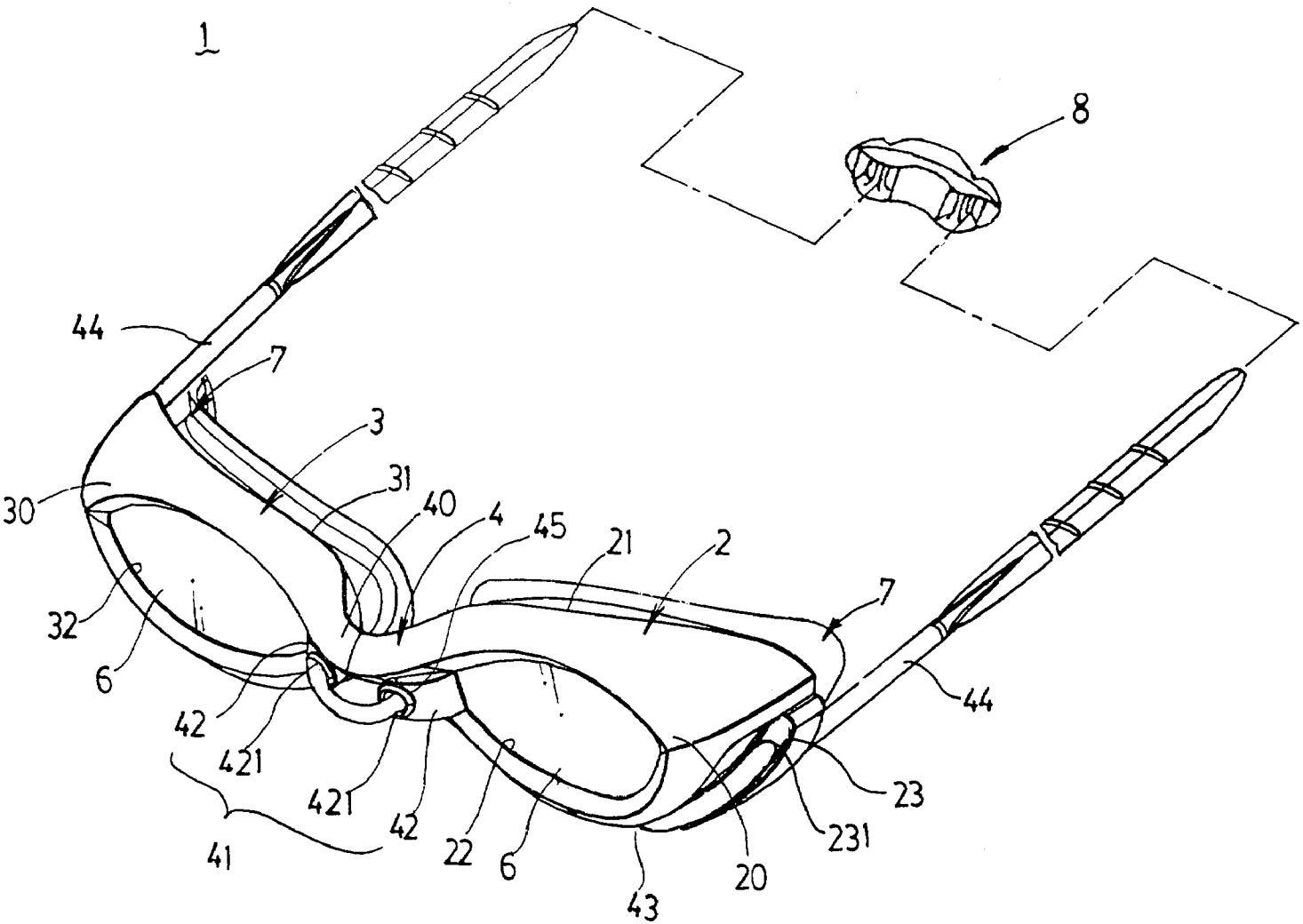
FIG. 1 is a perspective view of a pair of swimming goggles for swimming pool purposes of the first embodiment in accordance with the present invention.
Figure 2:
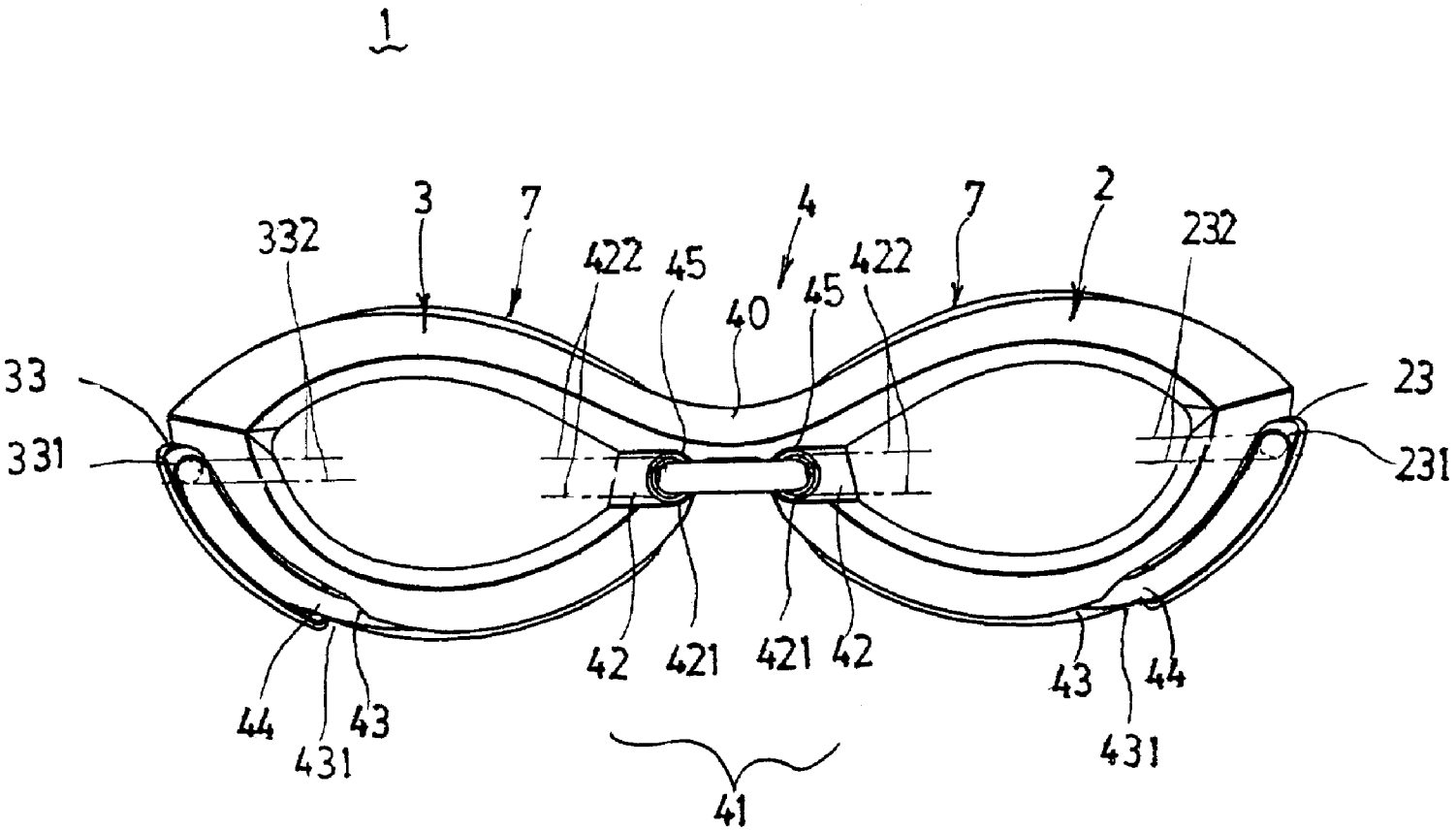
FIG. 2 is a front view of the swimming goggles in FIG. 1.
Figure 3:
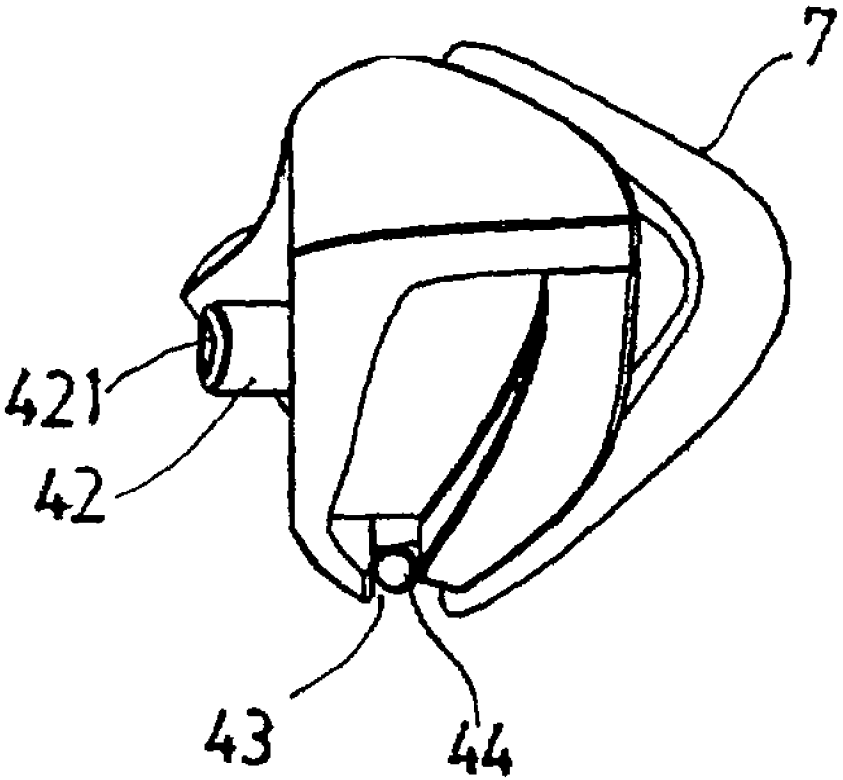
FIG. 3 and FIG. 4 are right lateral view and bottom view of the swimming goggles in FIG. 1.

Referring to FIGS. 1 to 3, a pair of swimming goggles for swimming pool purposes of the present invention comprises a left lens frame 2, a right lens frame 3, and a bridge member 4. The left and right lens frames 2, 3 include outer surfaces 20, 30 and inner surface 21, 31, respectively. A pair of receiving grooves 22, 32 is defined between the inner and outer surfaces for properly retaining lens units 6. A pair of gaskets 7 is integrally formed on the inner surfaces 21, 31 of the left and right lens frames 2, 3 for providing a comfort contact with eye holes of the wearer. Moreover, a pair of head strap joint sections 23, 33 which define apertures 231, 331 therethrough is formed on outer sides of the left and right lens frames 2, 3, respectively.

The bridge member 4 includes a connection section 40 and an adjustment section 41, wherein the connection section 40 integrally extends from the upper edges of the inner sides of the left and right lens frames 2, 3. The adjustment section 41 includes a joint member 42, a coupling passage 43 (also referring to FIG. 3), and a flexible thread 44. The joint members 42 which are disposed on the inner sides of the left and right lens frames 2, 3 and are adjacent to the lower portion of the connection section 40, locates approximately at the central position between the inner sides of the left and right lens frames 2, 3. An hole 421 is defined in the joint member 42 for allowing the flexible thread 44 to extend therethrough. A sleeve section 45 in which a space that is communicated with environment at both ends thereof is mounted within the hole 421, thereby strengthening the structure of hole 421 for facilitating the pass of the flexible thread therethrough. It is noted that a certain distance 431 which extends from outer edge of the left and right lens frame is reserved between the head strap joint section 23, 33 and the coupling passage 43. Therefore, a head strap which is the extension of the flexible thread 44 could extend through the joint member 42 and the coupling passage 43, and be secured at the certain distance 431 between the coupling passage 43 and the head strap joint sections 23, 33, then extend through the head strap joint sections 23, 33. Additionally, also referring to FIG. 2, an area between a pair of tangents 422 of the cross section of the holes 421 of the joint members 42 should be overlapped with an area between a pair of tangents 232, 332 of the apertures 231, 331 of the head strap joint sections 23, 33 (noted: when actually implemented, an area between a pair of tangents 232, 332 of the cross section of the apertures 231, 331 should at least partially be overlapped with an area between a pair of tangents 422 of the holes 421.), thereby providing a relatively uniform pull movement when wearing the swimming goggles.

Referring to FIG. 3, the coupling passage 43 is defined within the leading grooves defined in the lower edges of the left and right lens frames 2, 3. The distal ends of the flexible thread 44 with a desired length respectively extend through the holes 421 of the aforementioned joint members 42, and extend along the coupling passages 43 at the lower edges of the left and right lens frames 2, 3, then are secured within the certain distance 431 between the coupling passages 43 and the head strap joint sections 23, 33, and eventually extend along the surfaces of the head strap joint sections 23, 33 and extend through the apertures 231, 331 of the head strap joint sections 23, 33, afterwards, are connected with a head strap adjustment fastener 8 thereby forming a head strap. In other words, the flexible thread 44 functions as a head strap and a part of the bridge member, simultaneously.

Figure 4:
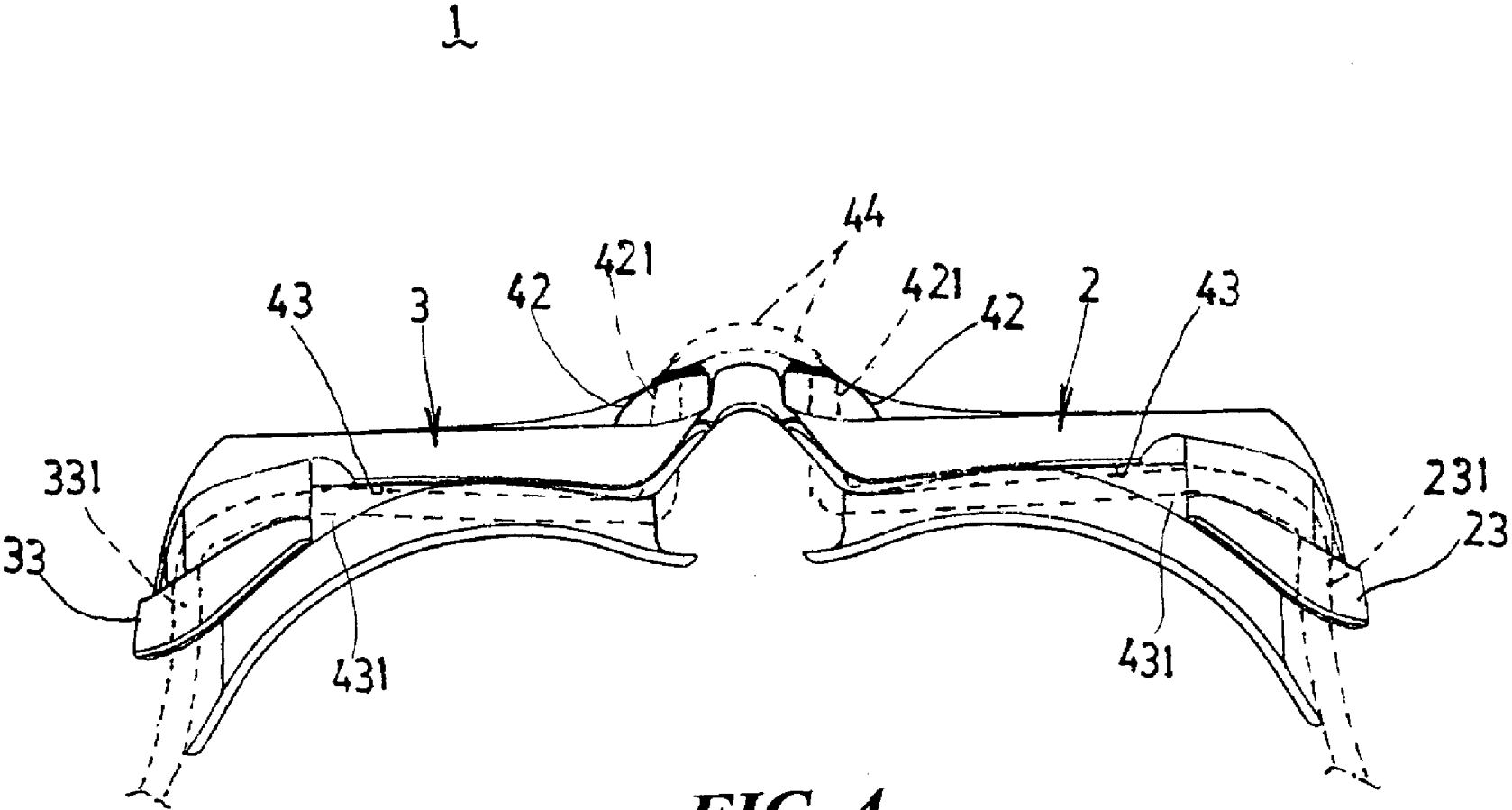

Also referring to FIG. 4, when wearing and adjusting the swimming goggles of the present invention, the wearing and adjusting steps include removing one end of the flexible thread 44 from the coupling passage 43, and adjusting the flexible thread 44 disposed between the inner sides of left and right lens frames 2, 3 according to the height and the width of the nose bridge of a wearer (as shown by the broken lines of FIG. 4), then securing the flexible thread 44 back into the coupling passage 43, thereby achieving the function of adjusting the bridge member according to the nose bridge. After the above mentioned adjustment, the flexible thread 44 disposed adjacent to the head strap joint sections 23, 33 is secured by the certain spaces 431 between the head strap joint sections 23, 33 and the coupling passages 43. Therefore, the head strap joint sections 23, 33 bear the pulling force when wearing the swimming goggles such that deformation of the lens frames 2, 3 resulting from the pulling is prevented. When the swimming goggles are used on the head of a wearer after being adjusted, since the flexible thread 44 disposed between the left and right lens frames 2, 3 has been properly adjusted according to the height and the width of the nose bridge of the wearer thereby avoiding a discomfort for the wearer due to an overly press on the nose bridge. As mentioned above, the head strap joint sections 23, 33 bear the pulling force when wearing the swimming goggles. Therefore, when being used, the left and right lens frames 2, 3 are pulled rearwardly and upwardly. The flexible thread 44 disposed between the left and right lens frames 2, 3 would not be affected thereby providing the flexible thread 44 a comfort contact with the nose bridge and avoiding undesired deformation of the lens frames 2, 3 and the seepage of water.

Figure 5:
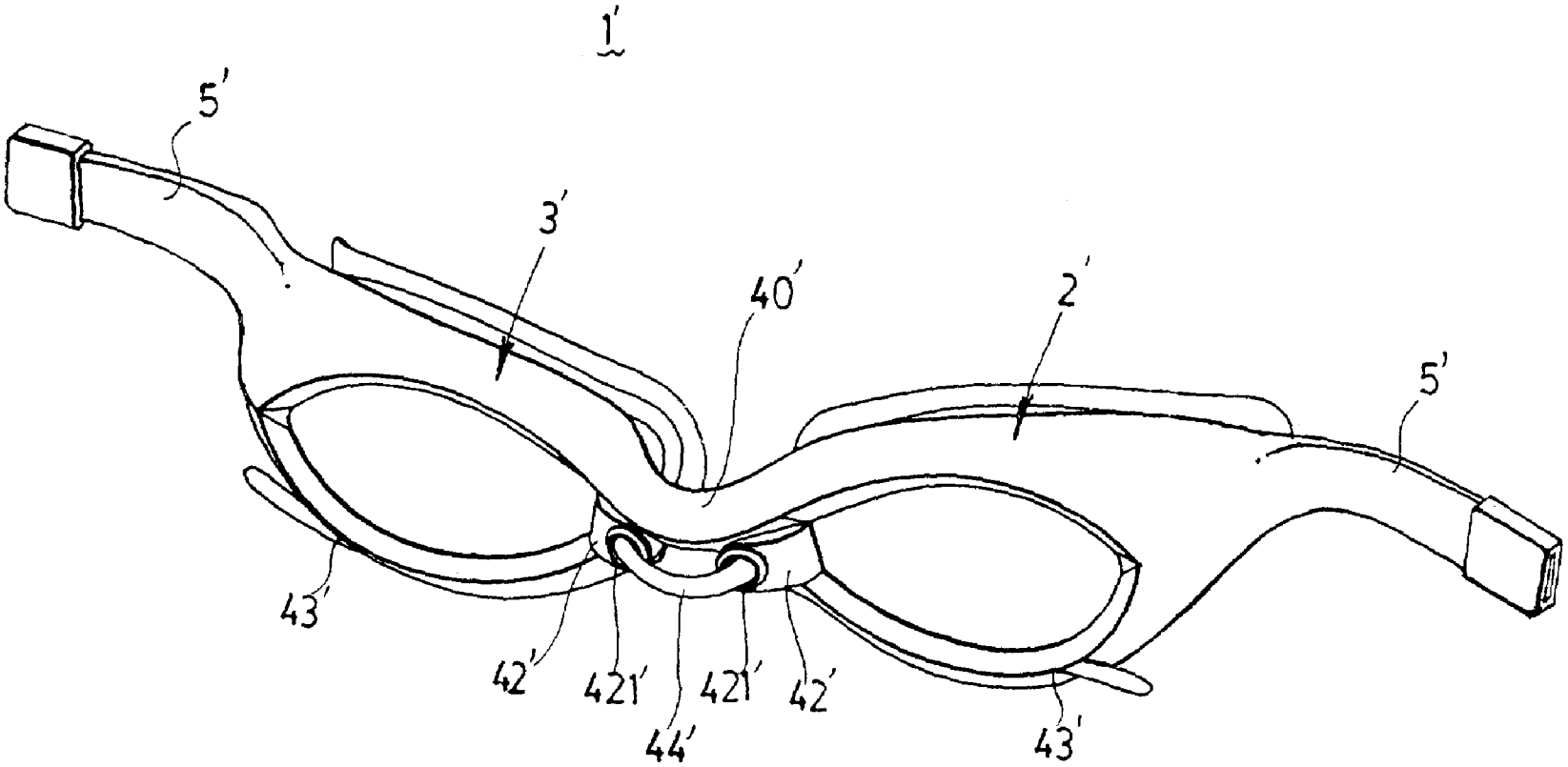
FIG. 5 is a perspective view of a pair of swimming goggles for swimming pool purposes of the second embodiment in accordance with the present invention.

Referring to FIG. 5 which is a perspective view of the of a pair of swimming goggles for swimming pool purposes of the second embodiment in accordance with the present invention, the second embodiment of the present invention differs from the first embodiment as described as below. The flexible thread 44' only functions as a part of adjustment of the bridge member 4' but not as the head strap. A pair of extensions 5' is formed on the ends of the outer sides of the left and right lens frames 2', 3' of the present embodiment. The flexible thread 44' only extends through the holes 421' of the joint member 42' and is secured within the coupling passage 43' (of course, the dimension of the leading grooves defined in the coupling passage 43' is slightly narrower than the dimension of the flexible thread 44' thereby securing the flexible thread 44' therewithin.). Therefore, such an arrangement is capable of adjusting the height of the bridge member according to the nose bridge of a wearer thereby providing a comfort wearing of the swimming goggles. Additionally, when the swimming goggle is pulled outwardly for being used, the left and right lens frames 2', 3' are pulled rearwardly and upwardly, while the connection section 40' or the flexible thread 44' disposed between the left and right lens frames 2', 3' would not be affected.

Although the invention has been explained in relation to its preferred embodiments, it is to be understood that many other possible modifications and variations can be made without departing from the spirit and scope of the invention as hereinafter claimed.

What is claimed is:

1. A swimming goggles for swimming pool purposes, comprising:

a left lens frame and a right lens frame, each lens frame including an outer surface and an inner surface, a receiving groove being defined between the inner and outer surfaces for receiving a lens unit, a head strap joint section being disposed at each of the lateral edges of the left and right lens frames;

a bridge member formed on the inner sides of the left and right lens frames, the bridge member including a connection section and an adjustment section, both ends of the connection section integrally being disposed on the upper edge of the inner sides of the left and right lens frames, the adjustment section at least includes a flexible thread arranged below the connection section, a joint member formed on the left or right lens frames for being inserted through by the flexible thread and a coupling passage defined on the left or right lens frames for securing the flexible thread, the flexible thread having an extension which becomes the head strap and extending through the joint member, the coupling passage and the head strap joint section.

2. The swimming goggles for swimming pool purposes as claimed in claim 1, wherein a hole is defined in the head strap joint section and an aperture is defined in the joint member for insertion of the flexible thread.

3. The swimming goggles for swimming pool purposes as claimed in claim 2, wherein the head strap joint sections outwardly extend from the lateral edges of the left and right lens frames and are reserved a certain distance from the coupling passages such that the flexible thread extends through the joint member and the coupling passage and is secured within the certain space between the head strap joint section and the coupling passage, then extends through the head strap joint section.

4. The swimming goggles for swimming pool purposes as claimed in claim 2, wherein a plurality of apertures is defined in the joint member and the head strap joint section, an area between a pair of tangents of the cross section of the aperture of the joint members being completely or partially overlapped with an area between a pair of tangents of the aperture of the head strap joint sections.

5. The swimming goggles for swimming pool purposes as claimed in claim 1, wherein a sleeve section in which a space that is communicated with environment at both ends thereof is mounted within the aperture of the joint section, thereby strengthening the structure of aperture for facilitating the pass of the flexible thread therethrough.

6. The swimming goggles for swimming pool purposes as claimed in claim 1 further including a gasket integrally formed on the inner surfaces of the left and right lens frames.

7. A swimming goggles for swimming pool purposes, comprising:

a left lens frame and a right lens frame, each lens frame including an outer surface and an inner surface, a receiving groove being defined between the inner and outer surfaces for receiving a lens unit;

a bridge member integrally formed on the inner sides of the left and right lens frames including:

a connection section having both ends integrally disposed on the upper edge of the inner sides of the left and right lens frames;

an adjustment section at least including a flexible thread arranged below the connection section, and a joint member formed on the left or right lens frames for being inserted through by the flexible thread and a coupling passage defined on the left or right lens frames for securing the flexible thread; and a head strap means disposed on the outer sides of the left and right lens frames.

8. The swimming goggles for swimming pool purposes as claimed in claim 7, wherein the coupling passage is disposed within leading grooves defined in the lower edges of the left and right lens frames, the dimension of the leading grooves being slightly narrower than the dimension of the flexible thread thereby securing the flexible thread therewithin.

9. The swimming goggles for swimming pool purposes as claimed in claim 8, wherein an aperture is defined in the joint member for being inserted through by the flexible thread.

10. The swimming goggles for swimming pool purposes as claimed in claim 7, wherein a sleeve section having a through hole mounted within an aperture of the joint member, thereby strengthening the structure of aperture for facilitating the pass of the flexible thread therethrough.

11. The swimming goggles for swimming pool purposes as claimed in claim 7 further including a gasket integrally formed on the inner surfaces of the left and right lens frames.

* * * * *